US006315428B1

(12) United States Patent
Chiang

(10) Patent No.: US 6,315,428 B1
(45) Date of Patent: Nov. 13, 2001

(54) LIGHT FIXTURE MOUNTING FOR SUSPENDED CEILING

(76) Inventor: Thomas Chiang, 28 W. 335 Picardy Ct., Winfield, IL (US) 60190

( * ) Notice: Subject to any disclaimer, the term of this patent is extended or adjusted under 35 U.S.C. 154(b) by 0 days.

(21) Appl. No.: 09/316,216

(22) Filed: May 21, 1999

(51) Int. Cl.[7] ..... F21S 8/02
(52) U.S. Cl. ..... 362/150; 362/148
(58) Field of Search ..... 362/147, 148, 362/150, 404, 406

(56) References Cited

U.S. PATENT DOCUMENTS

| | | | |
|---|---|---|---|
| D. 124,018 | 12/1940 | Davis . | |
| D. 246,399 | 11/1977 | Harris . | |
| D. 314,638 | 2/1991 | Kelley . | |
| D. 339,651 | 9/1993 | Vieyra . | |
| D. 360,270 | 7/1995 | Shemitz . | |
| 3,352,071 | 11/1967 | Sutter . | |
| 3,943,353 | 3/1976 | Tada . | |
| 4,075,775 | 2/1978 | Shorette . | |
| 4,222,091 | 9/1980 | Bartenbach . | |
| 4,290,218 | 9/1981 | Drueck . | |
| 5,055,985 | 10/1991 | Fabbri . | |
| 5,144,541 | 9/1992 | Schonbek . | |
| 5,174,642 * | 12/1992 | Brohard et al. | 362/150 X |
| 5,188,449 | 2/1993 | Davis et al. . | |
| 5,613,750 | 3/1997 | Roe . | |

* cited by examiner

*Primary Examiner*—Stephen Husar
(74) *Attorney, Agent, or Firm*—Robert L. Marsh

(57) ABSTRACT

A mounting for retaining a light fixture to a suspended ceiling has a body sized to fit within the frame member of a suspended ceiling. The body has connector holes for receiving a light fixture and an electrical box for connecting the fixture to the electrical system of a room.

2 Claims, 4 Drawing Sheets

LIGHT FIXTURE MOUNTING FOR SUSPENDED CEILING

The present application relates to the mounting of light fixtures, and in particular to the mounting of a light fixture which would hang below a suspended ceiling.

BACKGROUND OF THE INVENTION

At typical suspended ceiling has a grid of frame members which extend across the ceiling and consist of a first plurality of parallel frame members extending in one direction and second plurality of frame members extending perpendicular to the first frame members forming a plurality of rectangular or square openings. Each of the frame members has a horizontally oriented lower bar and a planar vertically oriented upper bar having a lower edge joined to the longitudinal center of the lower bar such that the frame member has a cross sectional shape of an inverted "T". The rectangular openings are therefore defined by vertical walls formed by the vertically oriented upper bars around which extends a lower lip formed by a portion of the horizontally oriented lower bar members.

The ceiling includes a plurality of rectangularly shaped panels with dimensions sized to fit between the vertical walls of the rectangular openings of the grid with the edges of the panels resting on top of the lips extending around each opening. The customary method of providing ceiling illumination for a room covered by a suspended ceiling, is to remove one of the ceiling panels and insert a lighting fixture having a rectangular frame with outer dimensions equal to the outer dimensions of the ceiling panel. Existing lighting fixtures for use with suspended ceilings, however, incorporate fluorescent light bulbs which are positioned above the plane defined by the ceiling panels such that the fixture is recessed within the ceiling. These fixtures provide adequate light to a room covered by the suspended ceiling, but they have no aesthetic appeal.

A chandelier, for example, is a light fixture which is aesthetically appealing. The prisms which make up a chandelier reflect light which can compliment the other decorative qualities of the room such that the decoration of the room including the ceiling and the lighting is aesthetically attractive. Presently there is no conventional method for incorporating ceiling lighting into the aesthetic decorations of a room which is covered by a suspended ceiling, and it would therefore be desirable to provide a mounting for a light fixture which can support a chandelier or other lighting element and be useable with a suspended ceiling to add to the appearance of the room.

SUMMARY OF THE INVENTION

Briefly, the present invention is embodied in a mounting for a light fixture adapted to be received within the grid which supports a suspended ceiling. The grid has first plurality of frame members extending in a first direction and a second plurality of parallel frame members extending in a second direction perpendicular to the first plurality of frame members, and each of the frame members has a horizontally oriented lower bar and a vertically oriented upper bar extending along the center of the lower bar thereby defining a plurality of rectangular openings, each of which has four vertical sidewalls and an inwardly extending lower lip extending along the lower edge of the sidewalls.

In accordance with the invention, the mounting for a lighting fixture includes a rectangular frame body having a flat bottom and vertical outer walls with outer dimensions which are a little less than the inner dimensions of the rectangular opening defined by the sides of the vertically oriented upper bar members between which the frame body is to be fitted. The frame body has a planar lower surface adjacent to the outer walls thereof which rest upon the lip extending around the edges of the opening in which it is to be retained. The device will accommodate at least one support member for connecting to the ceiling to the frame body to support the weight of the frame body and the light fixture so that the fixture will not fall because of the failure of the grid.

Another feature of the invention is that the rectangular frame body has a centering means for centering the frame body between the vertical walls of frame members of the grid. In the preferred embodiment, the centering means includes a plurality of alignment members along the outer walls thereof, each of which is mounted near the bottom of the frame body and has an outer surface which slopes outwardly and upwardly from the outer wall of the frame body. When the frame body is inserted into the grid of the suspended ceiling, the sloping alignment members will center the frame body within the grid to maintain proper alignment of the frame with respect to the grid members of the suspended ceiling. Alternately, a spring clip can be attached to the frame body for providing centering of the frame body within the grid.

The invention further includes a mounting for receiving a lighting fixture suspended below the frame. In the preferred embodiment, the fixture would be removable from the frame body such that the frame body may first be installed within the grid of the suspended ceiling after which any suitable light fixture can be assembled to the frame body.

BRIEF DESCRIPTION OF THE DRAWINGS

A better understanding of the present invention will be had after a reading of the following detailed description taken in conjunction with the following drawings wherein.

DETAILED DESCRIPTION OF THE PREFERRED EMBODIMENT

Figure 2:
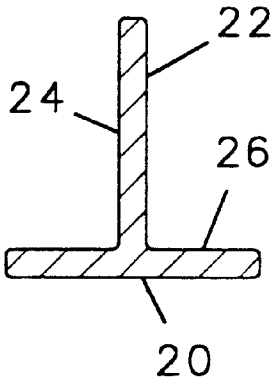
FIG. 2 is an enlarged cross sectional view of a frame member employed in a suspended ceiling.
Figure 1:
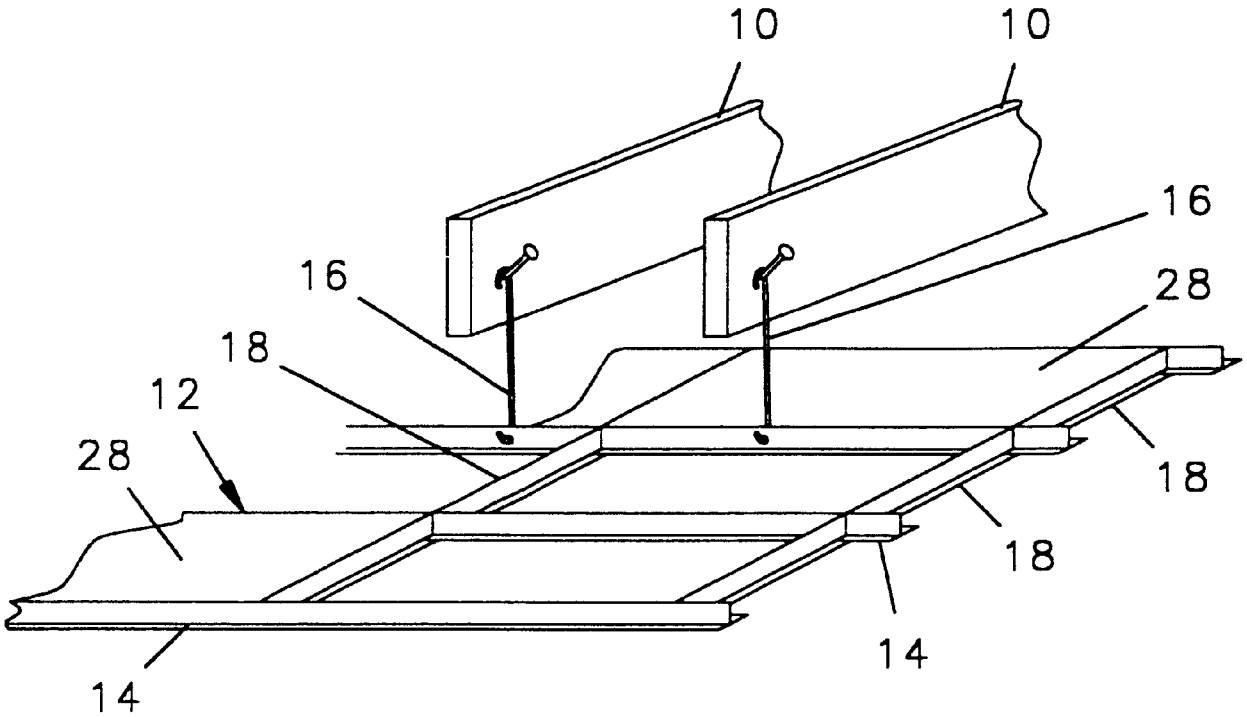
FIG. 1 is an isometric view of a ceiling of a room below which a grid for retaining a suspended ceiling has been constructed.

Referring to FIGS. 1 and 2, the unfinished ceiling of a room has exposed beams 10 and other unsightly elements such as conduit through which electrical wiring extends, not shown, all of which can be concealed by providing a suspended ceiling 12 below the beams 10. The suspended ceiling 12 consists of a plurality of parallel elongate first frame members 14 which are maintained in the desired elevation by wire connectors 16 extending between the frame members 14 and the beams 10. Extending perpendicular to the first frame members 14 are a second plurality of parallel second frame members 18 to form a grid which defines a plurality of rectangular openings as shown.

Each of the frame members 14, 18 has a generally planar horizontally oriented lower bar member 20 and a generally planar vertical bar member 22, the lower edge of which extends along the longitudinal center of the horizontal bar member 20, such that when a frame member 14, 18 is viewed in cross sections as shown in FIG. 2, it has the shape of an inverted "T". The rectangular openings formed by the frame members 14, 18, therefore, have four horizontal sidewalls wherein the sidewalls are defined by the sides 24 of the vertical bar members 22, and extending around the lower edge of the sidewalls 24 of each opening is an inwardly extending lip formed by the upper surfaces 26 of the horizontal bar members 20.

Retained within the rectangular openings defined by the frame members 14, 18 are a plurality of ceiling panels 28, each of the which is sized to slideably fit between the side walls 24 of the openings, yet large enough so that the outer edges of the ceiling panels 28 rest upon the inwardly extending lips 26. Such ceiling tiles generally have dimensions sized to fit within a grid where the center lines of the frame members 14, 18 are spaced two feet or four feet, from one another.

Figure 3:
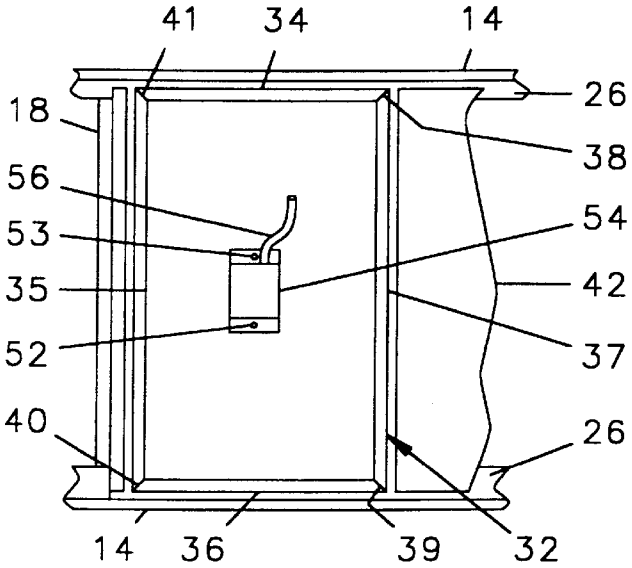
FIG. 3 is a top view of a mounting for a light fixture in accordance with the present invention.
Figure 4:
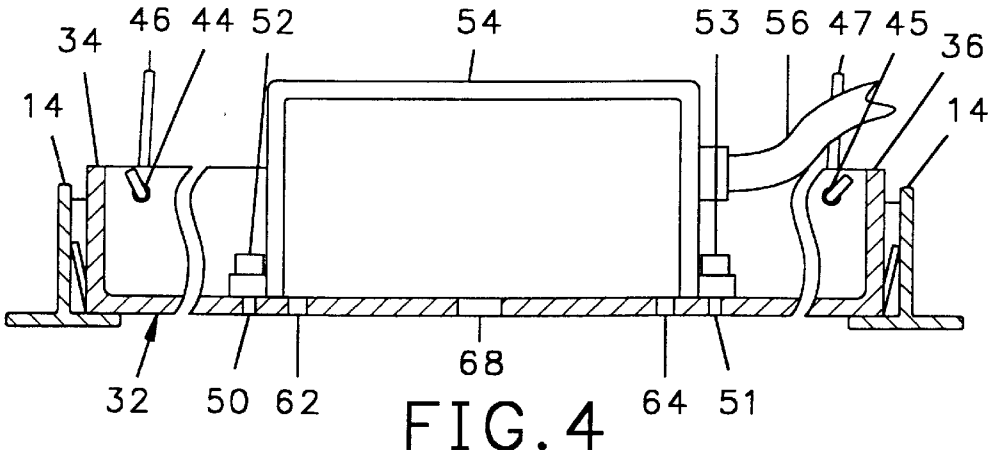
FIG. 4 is an enlarged fragmentary cross sectional view of the mounting shown in FIG. 3.

Referring to FIGS. 3 and 4, in accordance with the present invention there is provided a mounting 30 for a light fixture formed from a planar rectangular metal frame body 32 the outer ends of which have been folded upward to define four upstanding sidewalls 34, 35, 36, 37. Welds 38, 39, 40, 41 retain the ends of adjacent sidewalls to each other and provide rigidity to the frame body 32. In one embodiment the sidewalls 34–37 define a square the outer dimensions of which are sized to fit between the sides 24 of the frame members 14, 18 and rest on the upper surfaces 26 of the lips thereof. Alternately, the frame body 32 can define a rectangle with the dimension of the long sides 35, 37 thereof sized to fit between the openings of the grid and rest on the surfaces 26 as shown in FIG. 3. When the frame body 32 does not fill the rectangular opening defined by the frame members 14, 18 of the suspended ceiling, a filler 42 cut from a ceiling panel 28 can be inserted to occupy the position of the opening not covered by the frame body 32.

A plurality of apertures 44, 45 are provided along the sidewalls 34–37 through which wire connectors 46, 47 can be attached to retain the frame body 32 to the beams 10 of the ceiling. I have found that the frame members 14, 18 of a suspended ceiling can bear a light fixture weighing thirty pounds or more, but it is desirable to retain the frame body 32 to the ceiling by connectors 46, 47 to prevent injury in the event of the failure of the frame members 14, 18.

The frame body further includes a plurality of threaded holes 50, 51 spaced for receiving screws 53, 54 extending through the holes of an electrical box 54 for retaining the box 54 thereto. Power can be provided to the box 54 by conduit or by BX 56 cable connected to the electrical system of the room. On the lower surface of the frame body 32 is a fixture mounting 60 which includes a plurality of spaced threaded holes 62, 64 as shown. Within the pattern defined by the threaded holes 62, 64 is a central opening 68 through which electrical wiring for connecting a light fixture to the wiring in the box 54 can extend.

Figure 7:
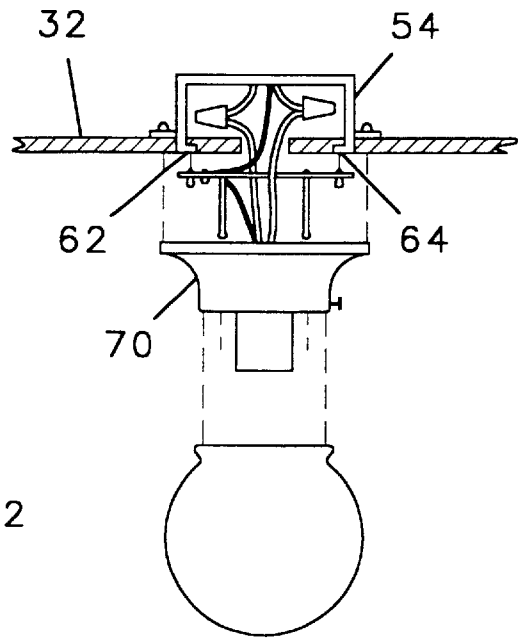
FIG. 7 is a reduced, fragmentary cross sectional view of a first fixture attached to the mounting shown in FIG. 3.
Figure 8:
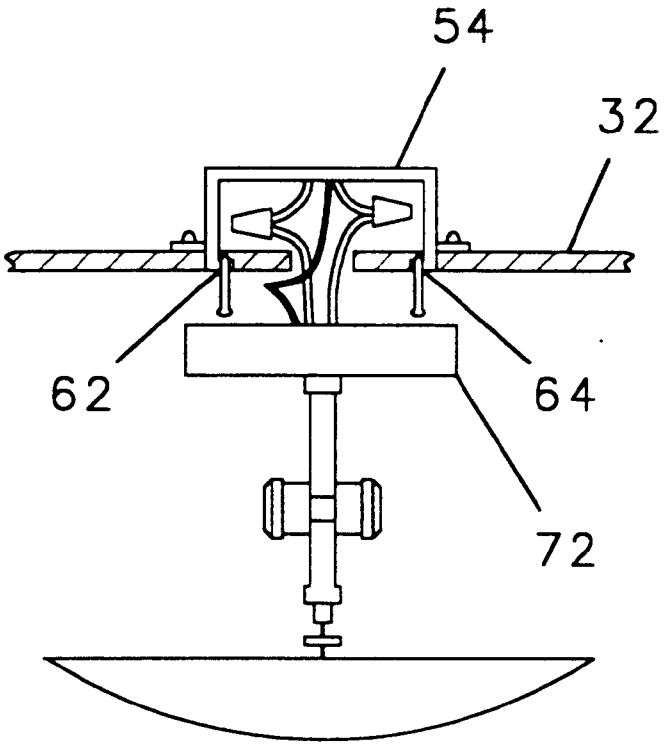
FIG. 8 is a reduced fragmentary cross sectional view of a second fixture attaching to the mounting shown in FIG. 3.

The holes 62, 64 have spacings chosen to accept screws extending through commonly used flush mounting plates for mounting light fixtures. Such mounting plates have standard spacings and therefore the mounting member 30 can receiving any commonly available light fixture such as fixtures 70 and 72 shown in FIGS. 7 and 8 respectively.

Figure 6:
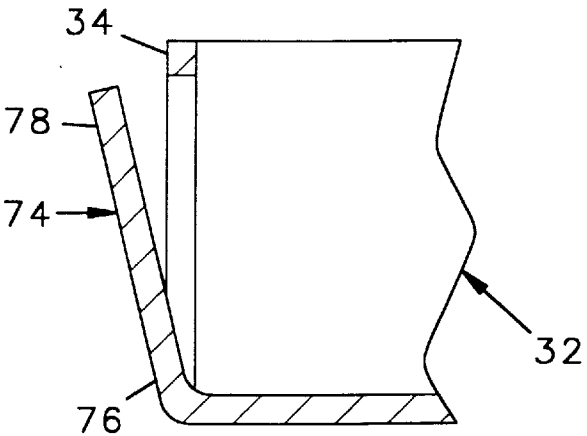
FIG. 6 is a cross sectional view of the alignment member shown in FIG. 5.
Figure 5:
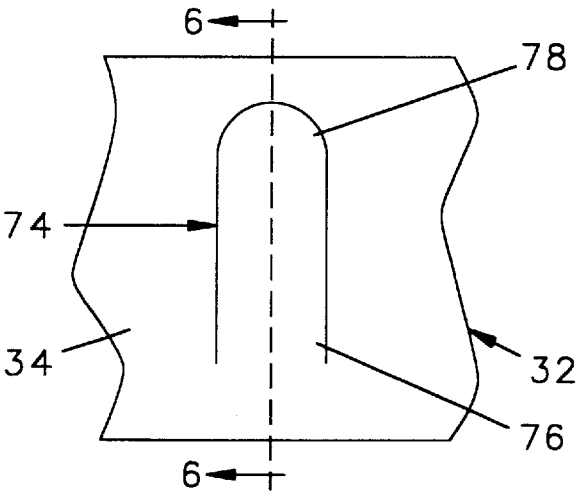
FIG. 5 is an enlarged side view of an alignment member for use with the mounting for a fixture shown in FIG. 3.

Referring to FIGS. 5 and 6, to center the frame body 32 within a rectangular opening of the suspended ceiling a plurality of centering members 74 are spaced along the sidewalls 34–37 of the frame body 32. Each of the centering members 74 is an elongate metal tongue, the lower end 76 of which is attached to the sidewall 34 of the frame body 32 and the upper end 78 of which is spaced from the sidewall and slopes outwardly and upwardly. As shown, the centering members 74 may be inverted U-shaped cutouts in the metal defining the walls 34 of the frame body 32 with the upper ends of the cutouts bent outward. The centering members 74 assist in aligning the frame body 32 within the center of the opening defined by the frames 14, 18 of the suspended ceiling 12 and therefore facilitate the installation of the frame 32 into the suspended ceiling.

Figure 9:
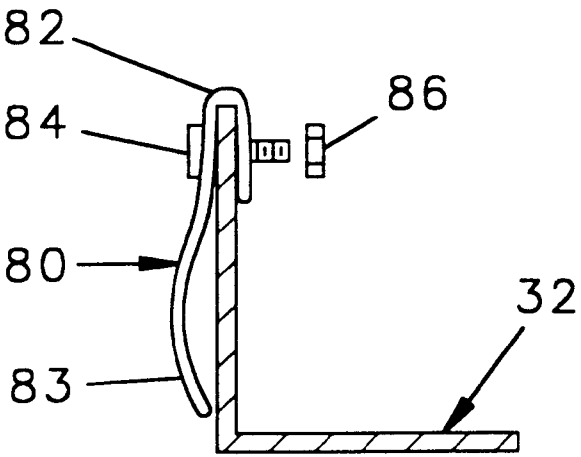
FIG. 9 is a side view of an alternate embodiment of an alignment member for aligning the mounting shown in FIG. 3.

Referring to FIG. 9, the frame body 32 can also be centered within the frame members 14, 18 by providing a plurality of removable clips 80 along the side walls 34 of the frame body. In this embodiment, each clip 80 is made of spring steel and at the upper end has an inverted U-shaped attachment portion 82 which is fitted over the upper edge of the side wall 34 and the parts are retained together by a bolt 84 and a nut 86 as shown. The lower portion of the clip 80 is an outwardly protruding spring tongue 88 the outer surface of which engages the vertical portion of a frame member 14, 18 to facilitate the centering of the frame body 32.

While the present invention has been described with respect to a single embodiment, it will be understood by those familiar with the art that many modifications and variations may be made without departing from the true spirit and scope of the invention. It is therefore the intent of the appended claims to cover all embodiments which fall within the true spirit and scope of the present invention.

What is claimed:

1. A mounting for retaining a light fixture in a grid suspended below a ceiling, the grid having a first plurality of parallel frame members extending in a first direction and a second plurality of parallel frame members extending in a second direction perpendicular to said first plurality of frame members, each of said frame members having a planar horizontally oriented lower bar and a planar vertically oriented upper bar with a lower edge thereof joined along a center of said lower bar, the grid defining a plurality of rectangular openings having given dimension with vertical sidewalls and an inwardly extending lower lip, the mounting comprising a frame body defining a rectangle having opposing outer walls with outer dimensions a little less than said given dimensions of said rectangular opening, said frame body having a planar lower surface adjacent to said outer sidewalls for engaging said lip around said sidewalls, electrical connector means for connecting into an electrical system, light fixture connector means on a lower surface of said frame body for removeably retaining a light fixture below said frame body, and centering means for centering said frame within the rectangular opening defined by said first and second frame members.

2. The mounting device of claim 1 wherein said centering means comprises an upwardly and outwardly extending tongue having one end connected to a portion of an outer wall of said frame body.

* * * * *